US005687882A

United States Patent [19]

Mueller

[11] Patent Number: 5,687,882

[45] Date of Patent: Nov. 18, 1997

[54] FLEXIBLE DISPENSER WITH BLADDER

[75] Inventor: John J. Mueller, Chagrin Falls, Ohio

[73] Assignee: Containaire Incorporated, Chagrin Falls, Ohio

[21] Appl. No.: 455,658

[22] Filed: May 31, 1995

[51] Int. Cl.[6] ..... B65D 37/00

[52] U.S. Cl. ..... 222/212; 222/386.5; 222/481.5

[58] Field of Search ..... 222/95, 212, 209, 222/215, 386, 386.5, 481.5

[56] References Cited

U.S. PATENT DOCUMENTS

| | | | |
|---|---|---|---|
| 3,319,837 | 5/1967 | Mueller . | |
| 3,656,660 | 4/1972 | Mueller . | |
| 3,847,307 | 11/1974 | Hosek | 222/386.5 |
| 4,239,132 | 12/1980 | Mueller et al. . | |
| 4,760,937 | 8/1988 | Evezich | 222/95 |

FOREIGN PATENT DOCUMENTS 1168181 10/1969 United Kingdom .

*Primary Examiner*—Gregory L. Huson
*Attorney, Agent, or Firm*—Watts, Hoffmann, Fisher & Heinke

[57] ABSTRACT

A dispenser for fluid material includes a flexible container. A piston is adapted for movement within the container. An expansible bladder is connected to the piston. A first flow restrictor allows flow of displacement fluid only from outside the container into the interior of the bladder. A second flow restrictor allows flow of material only from within an interior portion of the container external to the bladder to outside the container. The container also preferably includes a rod supported in the container, the piston being movable on the rod. In another embodiment the bladder is connected to a collar movable on the rod.

31 Claims, 7 Drawing Sheets

FLEXIBLE DISPENSER WITH BLADDER

BACKGROUND OF THE INVENTION

1. Field of the Invention

This invention relates to dispensers, and more particularly to flexible dispensers that permit dispensing of material through deformation and displacing the dispensed material with fluid that enters an expansible bladder within the dispenser.

2. Prior Art

A dispenser is disclosed in U.S. Pat. No. 3,319,837 to Mueller, issued May 16, 1967, entitled "Dispensing Device." A bladder within a flexible container receives displacement fluid such as air that flows into the bladder after contents of the container have been dispensed by squeezing the container and then allowing the container to return to its original volume. The container employs one way valves to assure that displacement fluid only enters the bladder, in effect maintaining the contents adjacent the container so that the container is always "full" until empty. A disadvantage of this dispenser is that the manner in which the bladder expands is not controlled, resulting in possible trapping of the contents remote from the outlet, which is then difficult to dispense. Another dispenser is disclosed in U.S. Pat. No. 4,239,132 to Mueller et al., issued Dec. 16, 1980, and entitled "Apparatus For Facilitating Inflow Through Closure Threads of Dispenser." That dispenser includes a tube in a flexible container and through which displacement fluid such as air flows to inflate the bladder and displace material dispensed from the container. That construction provides some, but only limited control of bladder expansion.

SUMMARY OF THE INVENTION

The present invention is a dispenser for a fluid material. In its preferred form it includes a flexible and resilient container, a rod supported in the container, a piston slidably disposed on the rod, an expansible bladder connected to the piston, a first flow restrictor for allowing flow of air only from outside the container into the interior of the bladder, and a second flow restrictor for allowing flow of material only from within an interior portion of the container external to the bladder to outside the container.

The first flow restrictor includes a first passageway through the container and communicates with the interior of the bladder, and a first check valve that cooperates with the first passageway. The structure of the second flow restrictor may be adapted to suit the viscosity of the fluid material to be dispensed from the container. When the fluid to be dispensed is sufficiently viscous, the second flow restrictor may be merely a dispensing passageway through the container that communicates with an interior portion of the container external to the bladder. In that case, the viscous material itself inhibits foreign material, including displacement fluid, from undesirably entering the container through the second passageway. On the other hand, when a less viscous material is to be dispensed from the container, the second flow restrictor preferably includes a second check valve cooperating with the second passageway to inhibit foreign material from undesirably entering the container through the second passageway.

The container includes first and second end portions and a side wall extending between the two end portions. The first flow restrictor is located adjacent the first end portion and the second flow restrictor is located adjacent the second end portion. The bladder is advantageously connected to the container at the first end portion and surrounds the first passageway. The rod is preferably secured to the container at that end portion. The piston and bladder are arranged in the container such that when the container is filled with the material to be dispensed, the piston is located adjacent the first end portion and the bladder preferably forms a loop that extends from the piston substantially halfway along the container side wall away from the piston.

When it is desired to dispense material from the container, the container is flexed along the side wall. Internal pressure within the container forces the material through the second flow restrictor and out of the container through the second passageway. When flexing pressure on the container is then removed, the side wall returns to its original shape. The second check valve prevents displacement fluid such as air from entering the container through the dispensing passageway and ambient pressure outside the container overcomes the bias of the first check valve and ambient fluid (e.g., air) enters the bladder. Frictional forces between the piston and the rod resist the movement of the piston along the rod. Displacement fluid that has entered the bladder then flows past the piston into the loop of the bladder, and initially inflates the loop of the bladder and urges it toward the second passageway, maintaining the loop above the piston. The forces of the displacement fluid active within the bladder and on the piston continually maintain the piston adjacent the material to be dispensed.

With the above arrangements, the loop of the bladder, being positioned above the piston as the bladder expands, avoids random expansion and entanglement of the bladder and formation of pockets of material in the container, trapped alongside by the bladder, rather than displaced toward the dispensing passageway. Movement of the piston toward the second passageway neatly controls the bladder expansion and decreases the size of the loop as the material in the container is depleted. This assures not only that the dispenser is in effect always "full," regardless of the orientation of the container, but also that essentially the entire contents can be effectively dispensed.

The container thus is divided into two sections—a section of fluid material to be dispensed and a section of displacement air or other fluid. The respective volumes of these two sections vary inversely as the container, which is originally full of the material to be dispensed, is emptied through use.

In a preferred embodiment, the dispenser includes a flexible, resilient container having a dispensing end, and a bladder within the container attached at the opposite end and of a shape and size to fill the container when fully inflated. Also included is a flow restrictor at the dispensing end that allows outflow of contents when the container is squeezed. This restrictor prevents inflow of displacement fluid when the container returns to its original volume. There is an inlet passage to the bladder. A flow restrictor allows displacement fluid to enter the bladder from outside the container through the inlet passage and prevents displacement fluid from exiting the bladder through the inlet passage. A piston is movable within the container from the opposite end toward the dispensing end, and essentially obstructs the cross-section of the container. Flow of the contents of the container is obstructed in a direction from the dispensing end toward the opposite end of the container. This preferred embodiment can be accomplished in a number of ways as disclosed more particularly in the detailed description.

Other embodiments of the dispenser of the invention are contemplated to provide particular features and structural variants of the basic elements. The specific embodiments referred to as well as possible variations and the various features and advantages of the invention will become better understood from the detailed description that follows, when considered in connection with the accompanying drawings.

DETAILED DESCRIPTION OF PREFERRED EMBODIMENTS

Figure 1:
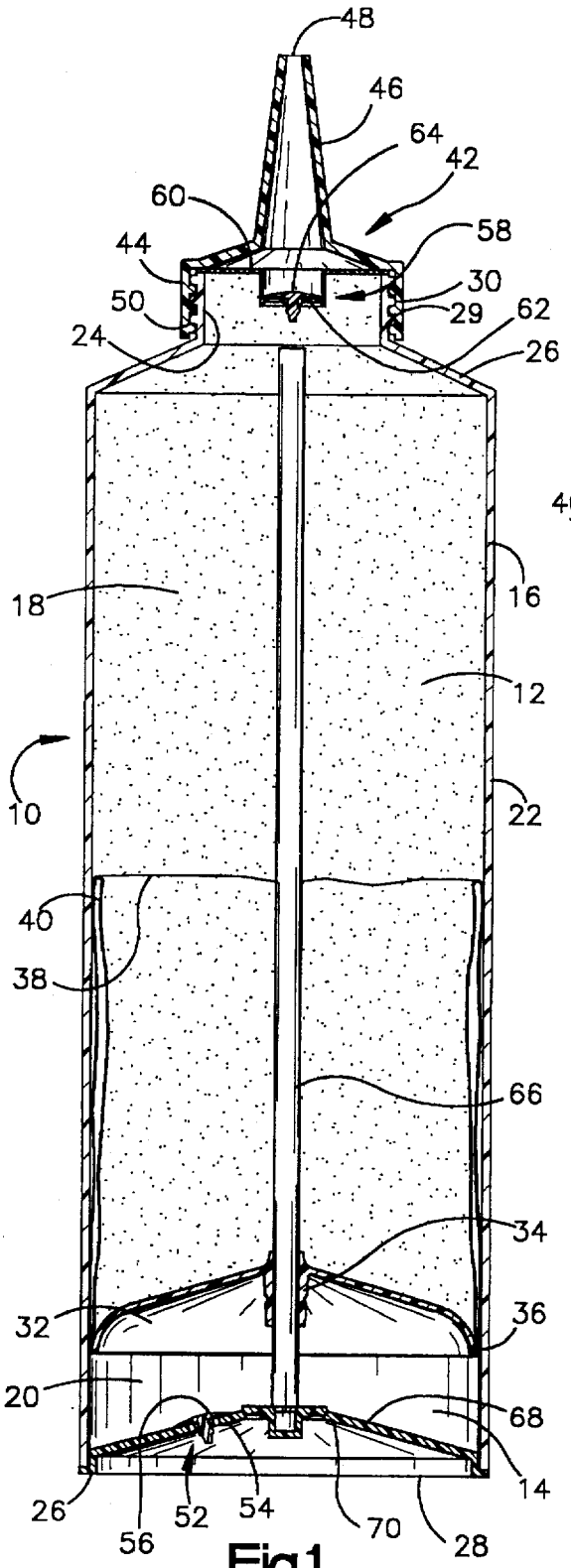
FIG. 1 is a longitudinal sectional view of a dispenser of the invention, showing a piston at the bottom of a substantially full container.

With reference to the drawings, a dispenser 10 is shown in FIG. 1, which includes a flexible and resilient container 16 made of plastic or the like having a dispensing end portion 26 and another end portion 28 with a side wall 22 extending therebetween. A piston 32 is adapted for movement within the container 16 toward the dispensing end portion 26 and an expansible bladder 38 is connected to the piston 32. A first flow restrictor 52 is located adjacent the end 28 and a second flow restrictor 58 is located adjacent the dispensing end portion 26. The bladder 38 is advantageously connected to the container 16 at the end portion 28 and sealingly surrounds the first flow restrictor 52. The first flow restrictor 52 allows flow of displacement fluid 14 such as air only from outside the container 16 into the interior of the bladder 38, and the second flow restrictor 58 allows flow of a fluid material 12 only from within an interior portion of the container 16 external to the bladder 38 to outside the container 16.

An opening 24 is provided at the dispensing end 26 of the container 16. At the dispensing end 26 and surrounding the opening 24, the container 16 has a neck portion 29 that is exteriorly threaded at 30. The dispenser 10 also includes a cap 42 having a downwardly extending skirt 44, and an upper tapered portion 46 extending therefrom to a cap opening 48. The skirt 44 of the cap 42 is interiorly threaded at 50, which threads 50 correspond to the exterior threads 30, for securing the cap 42 to the container 16.

Figure 3:
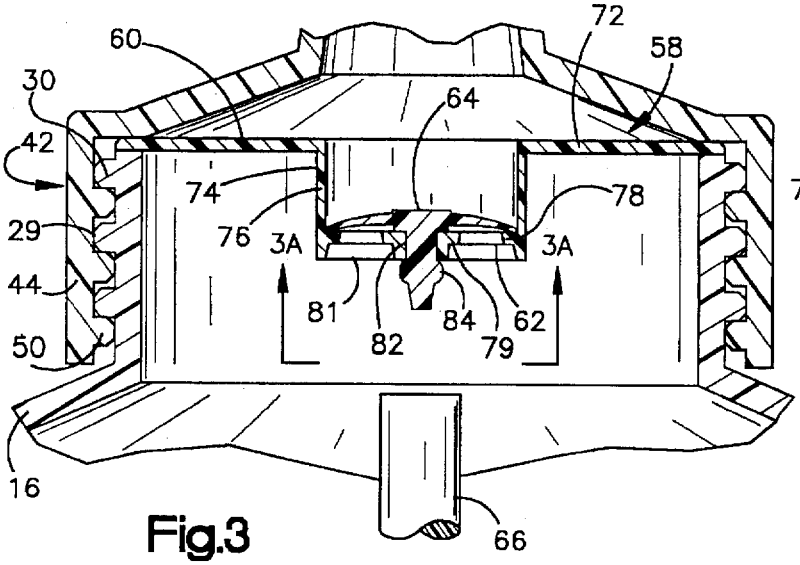
FIG. 3 is an enlarged sectional view of a flow restrictor at the dispensing end of the dispenser shown in FIG. 1.
Figure 3A:
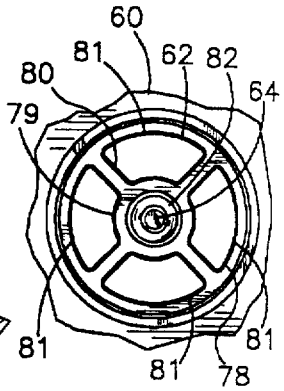
FIG. 3A is a view as seen from arrows 3A shown in FIG. 3.
Figure 4:
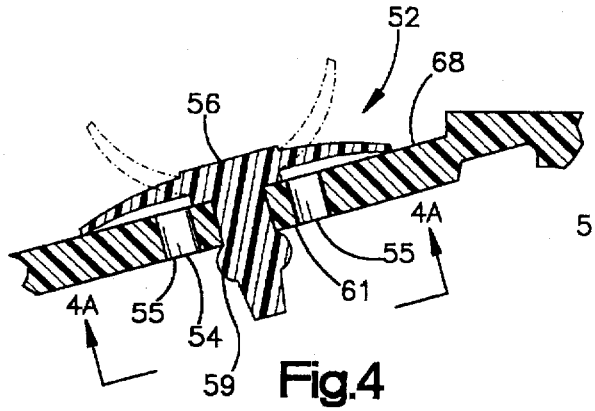
FIG. 4 is an enlarged sectional view of a flow restrictor at the inlet passage to the bladder of the dispenser shown in FIG. 1.
Figure 4A:
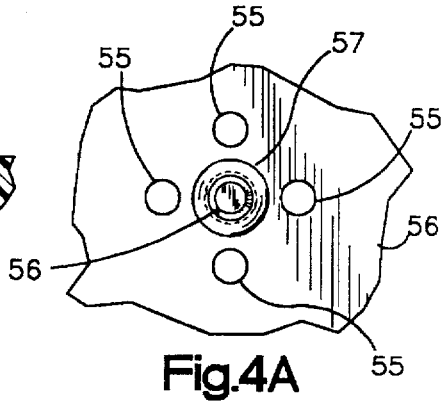
FIG. 4A is a view as seen from arrows 4A shown in FIG. 4.
Figure 5:
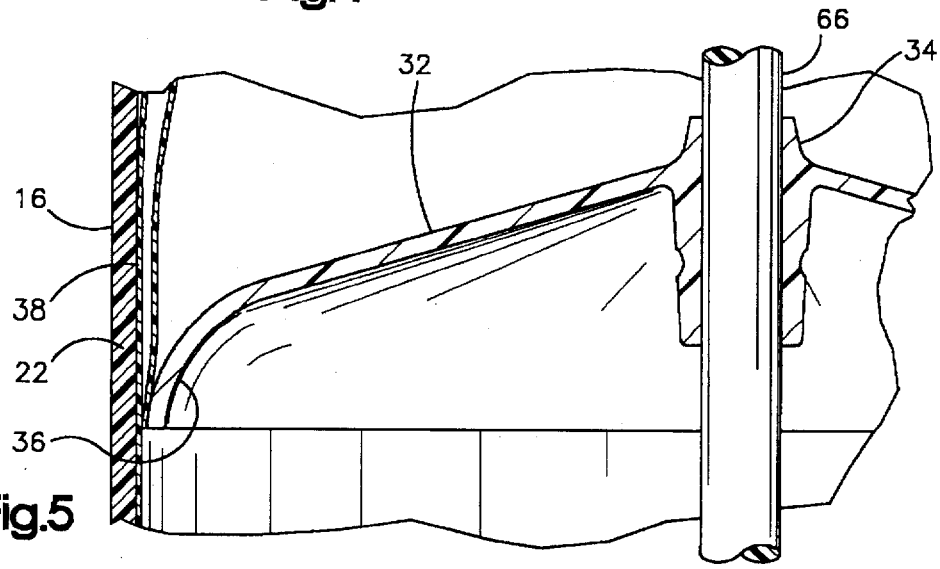
FIG. 5 is an enlarged sectional view of the piston and other elements of the dispenser shown in FIG. 1.

The first flow restrictor 52 includes a first passageway 54 into the container 16 and communicating with the interior of the bladder 38, and a first check valve 56 cooperating with the first passageway 54. The first passageway 54 is best shown in FIGS. 4 and 4A and includes, for example, four holes 55 spaced around a valve opening 61. This particular umbrella-type check valve 56 and check valve 64 shown in FIG. 3 is only one of many known check valve types that can satisfactorily be used. Advantageously, the check valves 56 and 64 are made of rubber. However, any suitable material may be used for the check valves 56 and 64, and such material may be selected for its desired response to fluids. In other words, the check valves 56 and 64 may use material of various resiliency. As shown in FIG. 4, the check valve 56 is secured within the valve opening 61 by a protuberance 59. The first check valve 56 normally closes the holes 55 of the first passageway 54, and its open position is shown by dotted lines.

The structure of the second flow restrictor 58 is adapted to suit the viscosity of the fluid material 12 to be dispensed from the container 16. When the fluid 12 is viscous, the second flow restrictor 58 may consist only of a second passageway 62 through the container 16 that communicates with an interior portion of the container 16 external to the bladder 38. In such a situation, the viscous material itself acts as a valve to inhibit foreign material including displacement fluid from undesirably entering the container 16 through the second passageway 62.

As best shown in FIG. 3, when a less viscous material 12 is to be dispensed, the second flow restrictor 58 also includes a second check valve 64. In a preferred construction, the second flow restrictor 58 includes a valve seat body 60 having a lip portion 72 extending around a cup portion 74 having a side wall 76 and a valve seat 78. The valve seat 78 includes a hub portion 79 having a valve opening 82 and, for example, four support spokes 80 branching out from the hub portion 79 and defining the second passageway 62, shown here as including, for example, four openings 81. The second check valve 64 is received by the valve opening 82 and normally closes the openings 81 of the second passageway 62.

Figure 2:
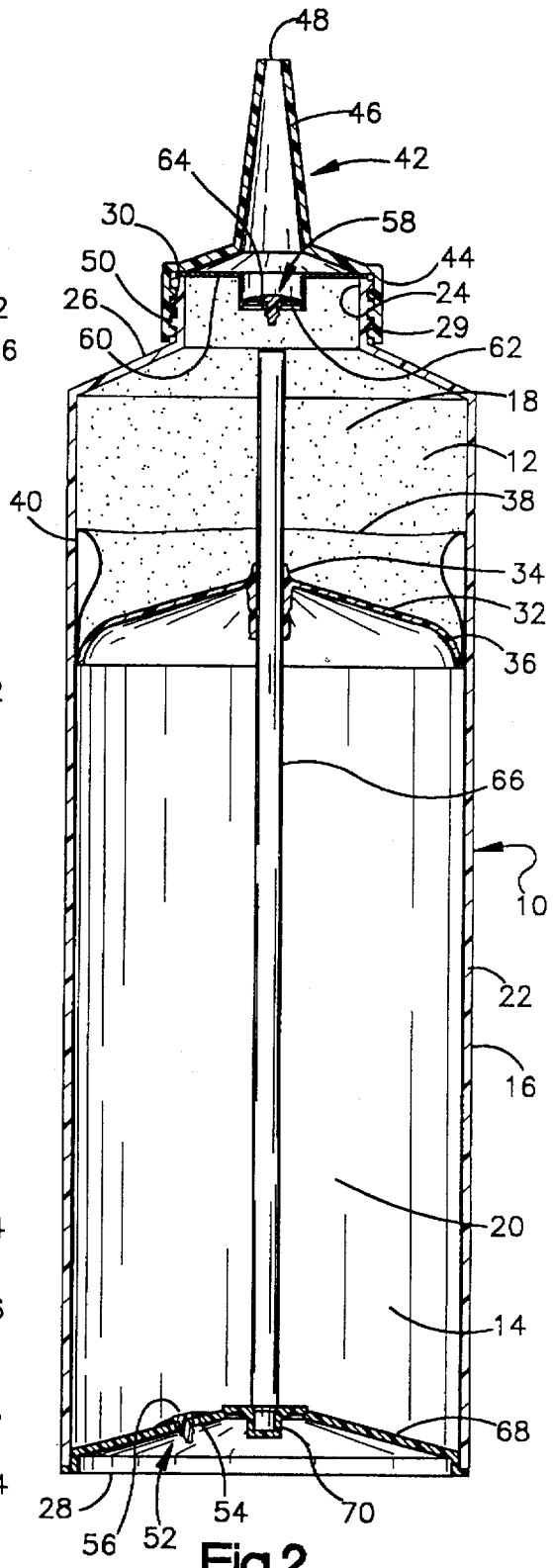
FIG. 2 is a longitudinal sectional view of the dispenser of FIG. 1, showing the piston located toward a dispensing end of a mostly empty container.

As shown in FIGS. 1 and 2, the piston 32 and the bladder 38 divide the container 16 into substantially two sections, a dispensing material section 18, and a displacing fluid section 20. Although in FIGS. 1 and 2 the piston 32 is shown with a collar 34 and rod 66, the dispenser 10 may be formed without the rod 66, and the piston 32 may be formed without a collar. Preferably, the bladder 38 has a size and shape to fill the container 16 when it is fully inflated. An open end of the bladder 38 is connected and sealed at the lower end 28 of the container 16 in surrounding relationship to the first flow restrictor 52 and the other end is connected to and sealed about the piston 32. The piston 32 may be flexible or rigid depending on the application, and is preferably formed of plastic or the like. If the piston 32 is flexible, it will deform a certain extent to conform to the contour of the side wall 22 when the container 16 is flexed and in that case the container 16 can be squeezed anywhere along its length including on the portion surrounding and contacting the piston 32.

Advantageously, the bladder 38 is arranged to extend above the piston 32 so as to form a loop 40 when the container 16 contains the fluid material 12. The loop 40 advantageously initially extends substantially halfway up the container sidewall 22 above the piston 32, as shown in FIG. 1. As is illustrated by comparing the length of the loop 40 in FIGS. 1 and 2, the loop 40 decreases in length as the piston 32 is moved upward along the rod 66. The loop 40 is advantageously located above the piston 32 at nearly all stages of dispensing the material 12, which effectively keeps the material 12 above the piston to prevent trapping material 12 within the container 16.

Figure 6:
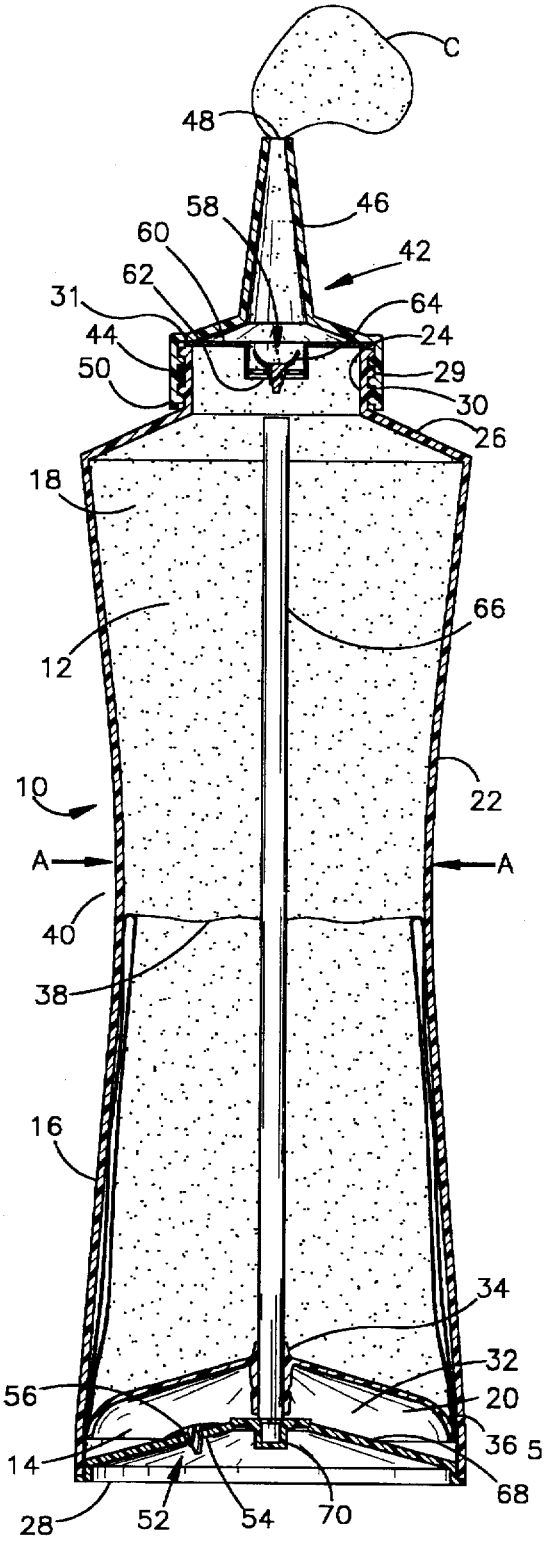
FIG. 6 is a sectional view showing operation of the dispenser of FIG. 1, with the container being flexed.
Figure 7:
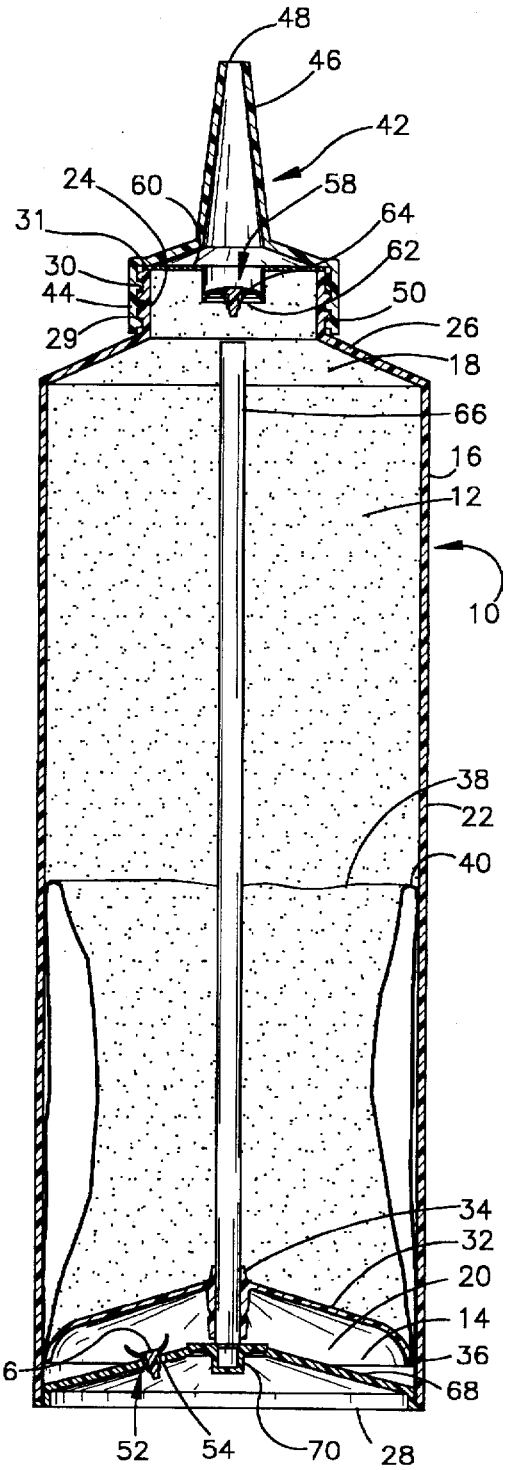
FIG. 7 is a sectional view showing operation of the dispenser of FIG. 1, with the container being released.

FIG. 6 shows the container 16 being squeezed in the direction of arrows A on the dispensing material section 18 above the piston. Upon squeezing the container 16, the second check valve 64 opens in response to a high internal pressure within the container 16 overcoming the bias of the second check valve 64 to permit dispensing of material C through the cap opening 48. In the meantime, the first check valve 52 remains closed so the volume of the bladder 38 will not diminish. As shown in FIG. 7, when the container 16 is released, the side wall 22 begins to move in a direction to assume its original shape. This reduces internal pressure and the second check valve 64 closes, preventing foreign material from entering the container 16 through the second passageway 62. The first check valve 56 also opens in response to the reduced internal pressure within the container 16, which is lower than ambient pressure outside the container 16. The outside pressure overcomes the bias of the first check valve 56, and displacement fluid 14 such as air flows into the container 16 through the first passageway 54. This air 14 acts on the bladder 38 and piston 32 to inflate the bladder 38 as shown in FIG. 7, and to retain or to move the piston in or to an advanced position directly against the fluid material 12. As a result of a "squeegee" effect of the inflated bladder against the side wall 22, as shown in FIG. 7, trapping portions of material 12 below the piston 32 or between the bladder 38 and the side wall 22 is avoided.

When the container 16 is full of the material 12, and squeezed above the piston 32, the fluid 12 is directly dispensed because downward movement or advancement of the piston 32 is prohibited by the displacement fluid 14 in the bladder 38. The piston 32 will then be forced upward by the upward flow and ambient pressure of the displacement fluid 14 that flows into the bladder 38 due to the decreased internal pressure resulting from the return of the side wall 22 to its original shape. Thus, pressure in the loop 40 and beneath the piston 32 constantly lifts or advances the piston 32 throughout dispensing. When the loop 40 of the bladder 38 begins to be filled by the displacement fluid 14, the bladder 38 will expand above the piston 32 until it balloons inward from the side wall 22 as shown in FIG. 7. When the container 16 is significantly empty and squeezed below the piston 32, the piston 32 will be forced upward toward the dispensing end 26 to discharge contents and then will be maintained there by the displacement fluid 14 that enters the bladder 38 when the side wall 22 returns to its original shape.

Internal pressure within the container 16 presses a portion of the bladder 38 forming the loop 40 (i.e., the portion of the bladder 38 shown in FIG. 7 closest to the side wall 22) against the inside of the sidewall 22 to prevent material 12 from being present between the inside of the sidewall 22 and the bladder 38. This pressing action of the bladder 38 against the inside of the sidewall 22 or "squeegee" effect occurs throughout the dispensing of material 12, since the filled loop 40 is present throughout dispensing. The pressing action of the bladder 38 against the sidewall 22 inhibits downward flow of material therebetween, and thus the loop 40 of the bladder 38 and the piston form a pouch that contains the material 12 above the piston 32.

The container 16 may also include a member that limits the degree of flexure to which the sidewall 22 can be subjected, as disclosed in U.S. Pat. No. 3,319,837, which is incorporated herein by reference. In this way, only a uniform, predetermined volume of the material 12 is dispensed.

As shown in FIGS. 1 and 2, a preferred embodiment of the dispenser 10 includes a rod 66 supported within the container 16. The rod 66 is shown mounted in an opening 70 of a base 68 at the lower end 28 of the container 16. However, any other suitable connection of the rod 66 to the container 16 in general, or specifically to the base 68, may be used. In this embodiment, the piston 32 is formed with a collar 34 for providing a friction fit between the piston 32 and the rod 66. This friction fit resists movement of the piston 32 along the rod 66 toward the cap 42. The bladder 38, connected at the lower end 28, is connected to the skirt 36 of the piston 32.

In operation, as shown in FIG. 6, when the container 16 is squeezed, for example in the directions of arrows A as in the first embodiment, the second check valve 64 opens in response to a high internal pressure in the container 16 overcoming the bias of the second check valve 64 to allow flow of the material 12 through the cap 42 out of the opening 48. The frictional engagement of the collar 34 of the piston 32 along the rod 66 resists upward movement of the piston 32. When the container 16 is released and begins to assume its original shape, as shown in FIG. 7, the second check valve 64 closes to prevent foreign material from entering the container 16, and the first check valve 56 opens in response to the internal pressure of the container 16 being less than the pressure outside of the container 16 which overcomes the bias of the first check valve 56. The frictional engagement between the collar 34 of the piston 32 and the rod 66, which resists the upward movement of the piston 32, assures that displacement fluid 14 flows past the piston 32 about its periphery to inflate the bladder 38 above the piston 32. Once the loop 40 of the bladder 32 has been fully inflated, as shown in FIG. 7, the forces on the bladder 38 and the piston 32 overcome the frictional resistance between the rod and collar and move or advance the piston 32 toward the dispensing end 26 of the container 16. As described with respect to the first embodiment, the inflated loop 40, which presses against the side wall 22, as well as the piston 32, act to maintain the material 12 above the bladder 38 and the piston 32.

Figure 8:
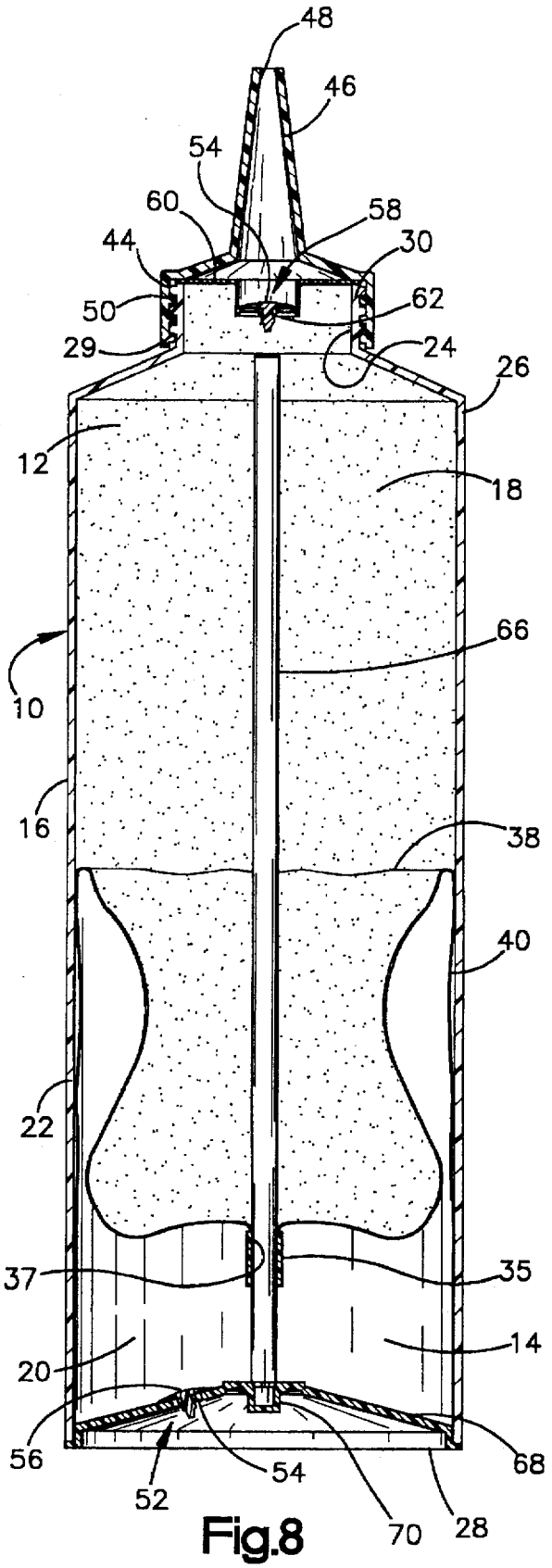
FIG. 8 is a longitudinal sectional view of another embodiment of the dispenser of the invention.

In a third embodiment, shown in FIG. 8, where like reference numerals designate like parts, instead of the piston 32 shown in FIG. 1, the dispenser 10 includes a collar 35 having an inner surface portion 37 that frictionally engages the rod 66. This frictional engagement resists movement of the collar 35 on the rod 66 and assures that the loop 40 of the bladder 38 is located above the collar 35 to prevent necking of the bladder 66 that could trap material 12 in the container 16. The loop 40 acts in a manner similar to the first two embodiments and exhibits a similar "squeegee" effect against the sidewall 22.

In operation, when the container 16 in the embodiment of FIG. 8 is flexed, the second check valve 64 opens in response to a high internal pressure within the container 16 overcoming the bias of the second check valve 64, and fluid material 12 is dispensed from the container 16 through the second passageway 62. Upon releasing the container 16 so that it assumes its original shape, the second check valve 64 closes to prevent foreign material from entering the container 16, and the first check valve 56 opens in response to an internal pressure within the container 16 being lower than the pressure outside the container 16 which overcomes the bias of the first check valve 56. Displacement fluid 14 such as air then enters the container 16 through the first passageway 54 and acts upon the loop 40 of the bladder 38 to maintain the loop 40 above the collar 35. When the loop 40 is fully expanded above the collar 35, the pressure of the displacement fluid 14 overcomes the frictional resistance between the collar 35 and the rod 66, causing the collar 35 to advance up the rod 66 toward the dispensing end 26.

In this embodiment, a piston 32 is not used, but the inflated loop 40 of the bladder 38 will inhibit material from entering between the bladder 38 and the side wall 22. However, by reducing the frictional engagement between the collar 35 and the rod 66 selectively along the rod, some of the fluid material 12 may be purposely located between the bladder 38 and the side wall 22 of the container 16. For example, by allowing the collar to slide relatively easily along the rod until it approaches the upper end of the rod, the bladder can expand upwardly without initially pressing against the side wall. By locating a number of discharge passageways in the side wall 22 rather than or in addition to the second passageway 62 at the dispensing end 26, contents can be dispensed along the side wall in response to pressure applied to the side wall.

By using variations in the diameter or surface finish of the rod 66, the collar 34, the collar 35 or the piston 32 in this or in other embodiments, the amount of frictional engagement, and hence the ease of movement of the collars 34, 35 or the piston 32 on the rod 66, may be adjusted as desired.

Figure 9:
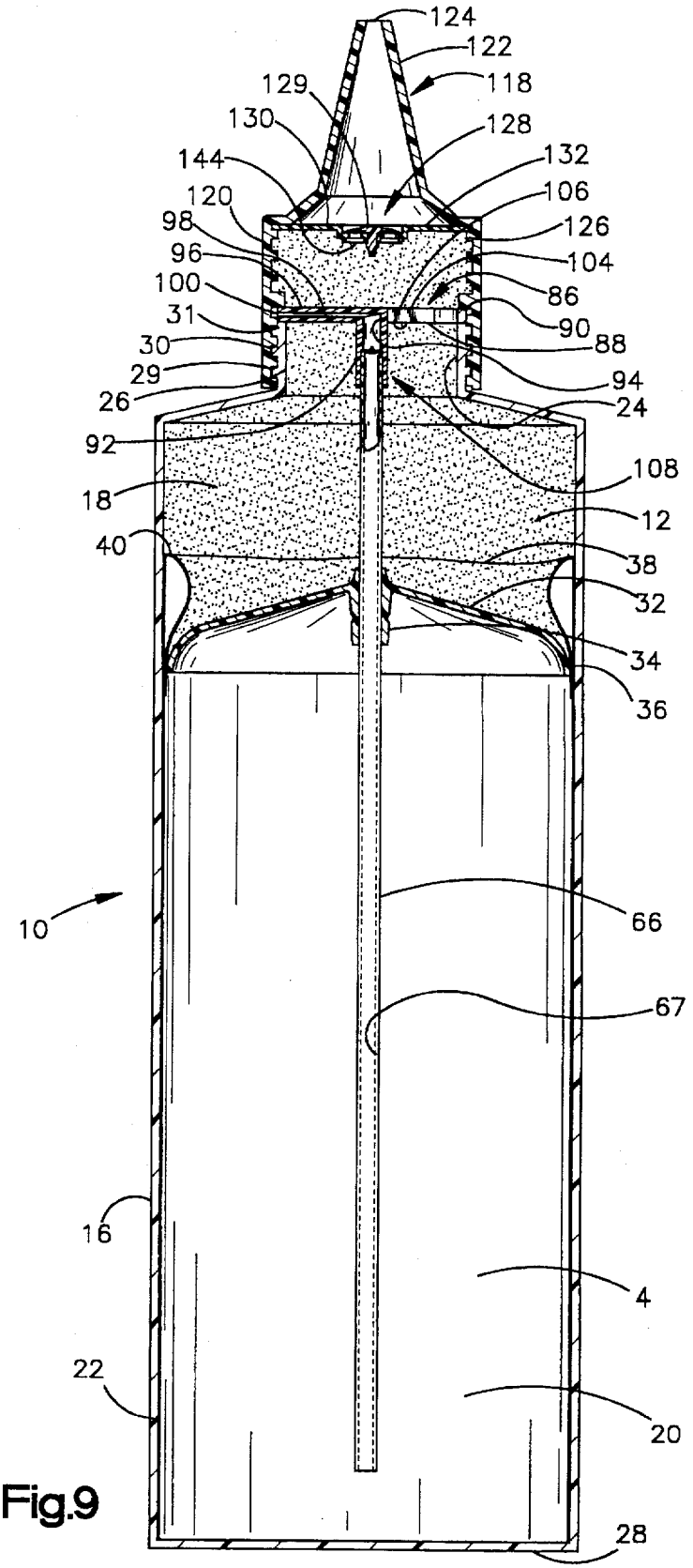
FIG. 9 is a longitudinal sectional view of another embodiment of the dispenser of the invention.
Figure 10:
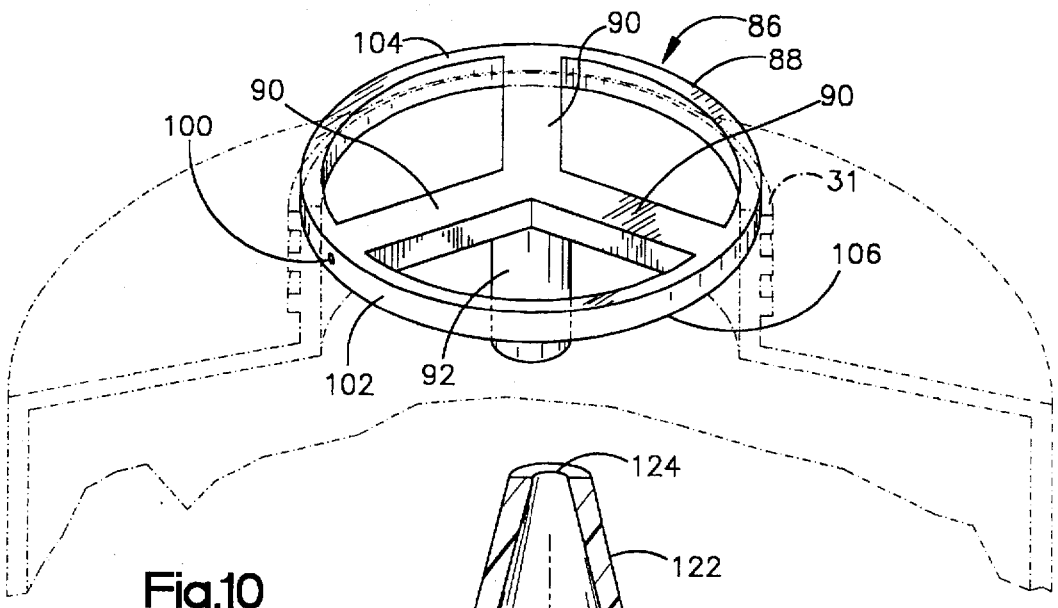
FIG. 10 is an enlarged perspective view of an intermediate member of the dispenser of FIG. 9.
Figure 11:
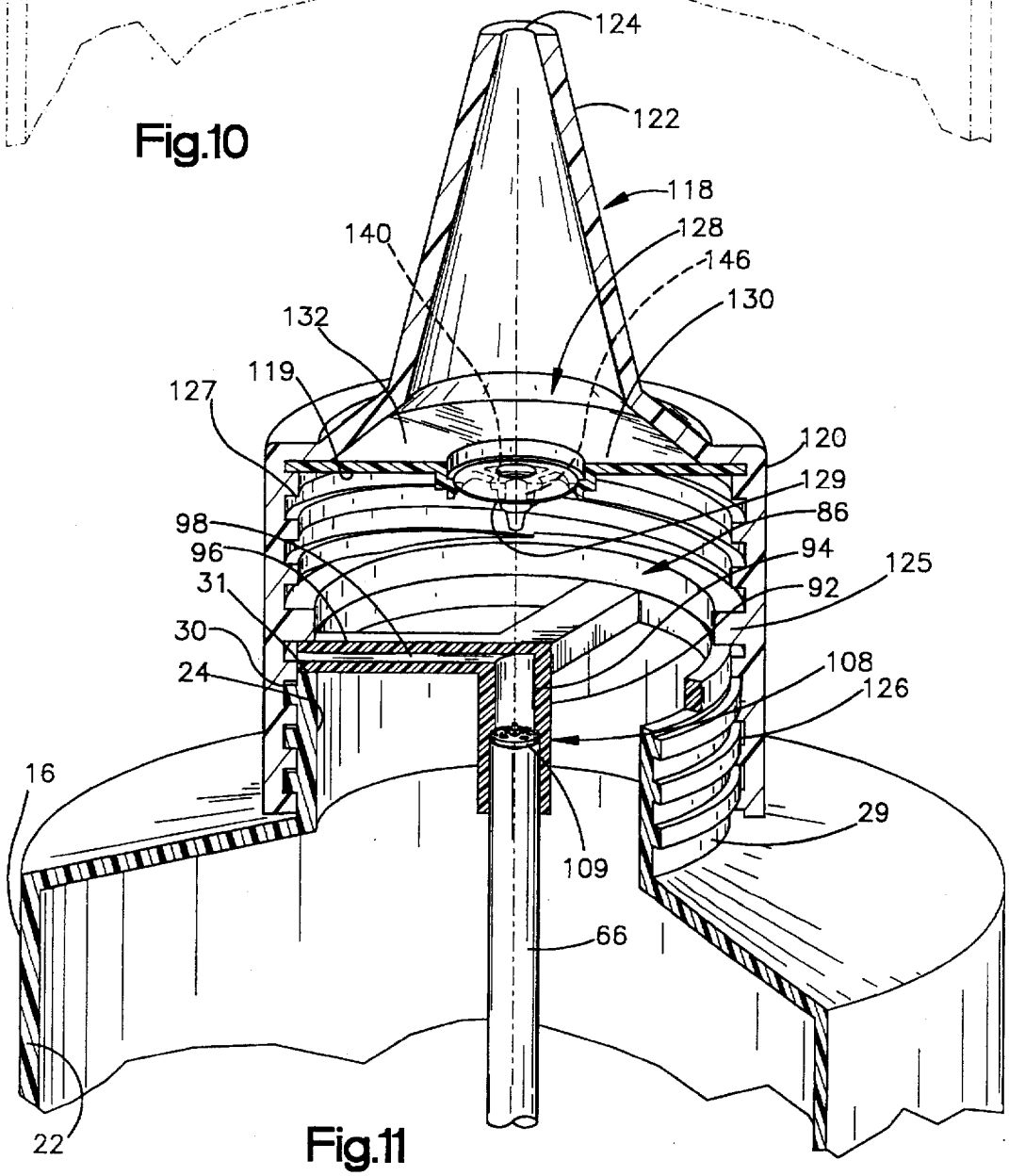
FIG. 11 is an enlarged cut-away perspective view showing the structure of the intermediate member and first and second flow restrictors.

Turning to FIGS. 9–11, showing another embodiment of the dispenser 10, like reference numerals designate like parts of previous embodiments, in some cases modified in the manner set forth below. The arrangement can be utilized with a piston and bladder as in FIG. 1 or with a collar and bladder as in FIG. 8. Aspects of this construction are similar to the construction shown in U.S. Pat. No. 4,239,132, the disclosure of which is incorporated herein by reference.

An intermediate member 86 of the dispenser 10 is located at the dispensing end 26 and includes a circular support 88 that rests upon the upper portion 31 of the neck portion 29. The circular support 88 has a smooth upper surface 104 and a smooth lower surface 106. Three radial spokes 90 extend from a central hub 92 to the circular support 88. One or more of the spokes 90 is a conduit 96. The central hub 92 has a cavity 94 formed in it leading to the conduit 96 through one of the spokes 90. An orifice 100 is formed in an outer peripheral surface 102 of the intermediate member 86 and leads to a passageway 98 of the conduit 96 as best shown in FIG. 11A.

A first flow restrictor 108 is located within the cavity 94 of the hub 92, which is similar to the first flow restrictor 52 shown in FIGS. 4 and 4A, and includes a valve seat 112 positioned at one side against a shoulder 110 of the hub 92. An upper end of the rod 66 presses against the other side of the valve seat 112 to keep the valve seat 112 in place. The rod 66 is tubular with an outlet 69 near the container end 28 and opening into the bladder 38 (FIG. 9). A first check valve 109 in the form of a flexible disk anchored at its center to the valve seat is positioned on the valve seat 112 so as to open to inward flow from the passage 98 to the cavity 94, thus allowing flow into the passage 67 of the rod 66. A first passageway 114 is formed in the valve seat 112 and includes, for example, four holes 116 as shown in FIG. 11A. This type of check valve is commercially available.

Figure 11A:
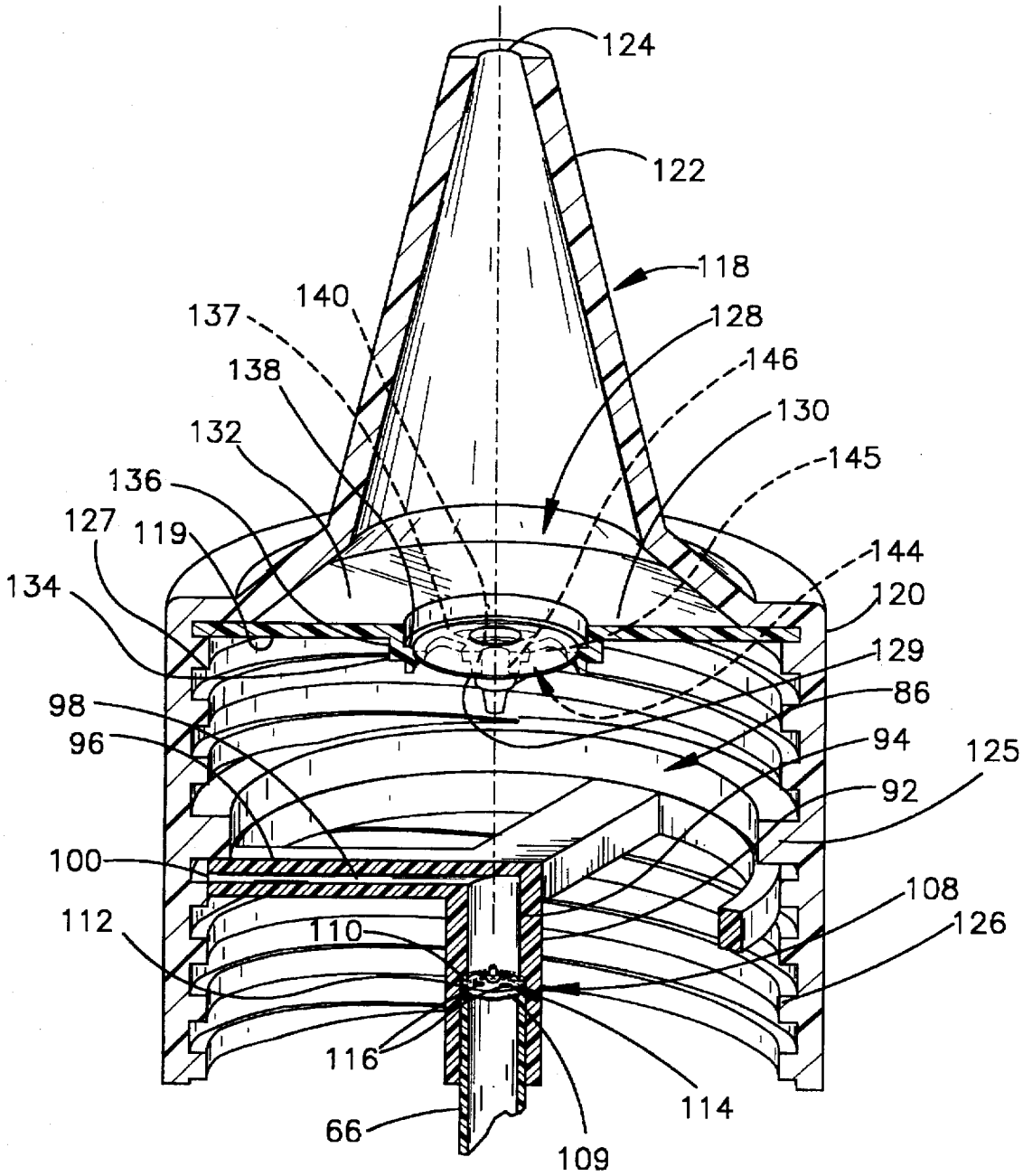
FIG. 11A is an enlarged cut away perspective view showing the structure of FIG. 11 without the container.

As shown by FIGS. 11 and 11A, a cap 118 for the container has a skirt 120, a tapered nozzle 122, and an outlet opening 124. An interiorly threaded portion 126 extends along an inner portion of the skirt 120. The threads 126 correspond to and engage the exterior threads 30 of the container neck portion 29. Thus, the cap 118, when screwed onto the neck 29, covers the opening 24 of the container 16. The cap 118 has a central annular portion 125 of smaller internal diameter than the threads that forms a shoulder that clamps and seals the intermediate member 86 against the upper end 31 of the container neck 29. Threads 127 above the portion 125 have the same pitch as the threads 126 and are provided to receive and seal a valve seat body 130 against an annular inner surface 119 of the cap 118 by screwing the body 130 into the cap 118 on threads 126, bending the body 130 past the annular portion 125, and screwing body 130 on the threads 127 until it is firmly against the surface 119.

If the material 12 has a high viscosity, no check valve needs to be used for a second flow restrictor 128. Preferably, however, the second flow restrictor 128 employs a valve seat and valve to restrict inward flow. In the embodiments shown, a valve seat body 130 is positioned above the uppermost threads 127 of the cap 118, and includes a disk 132 and a central passage 144 surrounded by a stepped annular flange 134 that extends away from the opening 124. The flange 134 includes a side wall 136 and an annular valve seat 138 from which spokes 137 extend, dividing the central passageway 144 into four openings 145. The spokes terminate in a hub 140, which receives the stem 146 of a second check valve 129 in the form of a flexible disk. When inoperative, the second check valve 129 covers the openings 145 of the passageway 144, sealed against the seat 138.

In operation, when the side wall 22 of the container 16 is flexed, the second check valve 129 opens in response to a high internal pressure within the container 16 overcoming the bias of the second check valve 129 and fluid material 12 is dispensed through the second passageway 144 and out of the opening 124 of the cap 118. When the container 16 is released and expands, the second check valve 129 reforms to its normally closed position to prevent foreign material from entering the container 16. The first check valve 109 in the cavity 94 opens in response to reduced pressure in the container 16, now lower than the pressure outside the container 16, which overcomes the bias of the first check valve 109. Displacement fluid 14 such as air passes between the threads 126 of the cap 118 and the threads 30 of the neck portion 29, into the orifice 100, through the passageway 98, into the cavity 94, through the first passageway 114, into the rod 66 and then into the bladder 38. The displacement fluid 14 then expands the bladder 38 in the manner described.

In all of the above embodiments, since the second check valve 64, 129 is formed in the removable cap 42, 118, the container 16 may be refilled with new material 12 by removing the cap 42, 118 and filling the container 16 after is has been emptied. To accomplish this, the first check valve 56 is opened to release the displacement fluid 14 from the bladder 38, and then the bladder 38 is depressed, along with the piston 32 or the collar 35, to their original positions.

The container 16 may take on geometric configurations having symmetrical upper and lower portions other than cylindrical, such as an hour glass shape, with a comparably shaped bladder, and can include a collar and rod to control expansion of the bladder. The rod and collar must of course fit through the waist of the hourglass shape. In addition, the bladder 38 need not have a size and shape to fill the container when it is empty, but may assume a variety of colors, shapes, and sizes. If the container 16 is formed of transparent plastic, and the bladder 38 is visible from outside the container 16, it can be in the form of a number of attractive shapes. For example, the bladder could be in the shape of a clown or the like. The container 16 may thus serve the dual purposes of dispensing material as well as entertaining children. Of course, some material will remain in the container if the bladder does not entirely fill the container due to a difference in shape.

Rather than using the cap 42, 118 having only an opening 48, 124 to dispense the fluid material 12, since the container 16 is always "full" of material until empty, i.e., gravity feed is not required, any number of applicators including rollers, sponges, brushes, atomizers, and the like may be used in conjunction with or in place of cap 42, 118, such as those disclosed in British Patent No. 1,168,181, which is incorporated herein by reference.

While preferred embodiments have been described in detail, various modifications or alterations can be made therein without departing from the spirit and scope of the invention set forth in the appended claims.

What is claimed is:

1. A dispenser for a fluid material, comprising a flexible container, a piston comprised of a material that enables the piston to be flexed, said piston being movable within the container, an expansible bladder connected to said piston, first flow restricting means for allowing flow of a displacement fluid only from outside the container into the interior of said bladder, and second flow restricting means for allowing flow of material only from within an interior portion of the container external to said bladder to outside the container.

2. A dispenser as set forth in claim 1 wherein said first flow restricting means comprises a first passageway into the container communicating with the interior of said bladder, and a first check valve cooperating with said first passageway.

3. A dispenser as set forth in claim 1, said second flow restricting means comprising a second passageway into the container and communicating with an interior portion of the container external to said bladder, and a second check valve cooperating with said second passageway.

4. A dispenser as set forth in claim 1, wherein said piston substantially obturates the container.

5. A dispenser as set forth in claim 1, wherein said container has different cross-sectional areas transverse to said rod at locations along said rod upon which the piston travels.

6. A dispenser as set forth in claim 1 wherein said first flow restricting means comprises at least one passageway disposed in a side wall of said container.

7. A dispenser as set forth in claim 1, wherein said bladder is comprised of a material that is substantially unstretchable, and said bladder surrounds said first flow restricting means and is connected to one end portion of said container remote from said second flow restricting means.

8. A dispenser as set forth in claim 7, wherein said rod is connected to the container at said one end portion.

9. A dispenser as set forth in claim 1, further comprising a rod supported in the container, said piston being movable on said rod.

10. A dispenser as set forth in claim 9, wherein said piston is in direct frictional and sealing engagement with said rod.

11. A dispenser as set forth in claim 9, wherein said rod is constructed to exert different frictional resistances to movement of the piston at different axial locations along said rod.

12. A dispenser as set forth claim 9, said container including two end portions and a side wall extending between the two end portions, wherein said bladder is arranged in the container such that when the container contains fluid material said bladder forms a loop that extends along the container side wall in advance of said piston with respect to piston movement toward the second flow restricting means.

13. A dispenser as set forth in claim 12, wherein said piston separates the container into a dispensing section for containing material and a displacement section for containing displacement fluid, and displacement fluid acts on a portion of the loop of said bladder in the dispensing section to frictionally move said piston on said rod.

14. A dispenser as set forth in claim 12 wherein said rod and said piston are constructed and arranged to have a frictional resistance therebetween of a magnitude which prevents movement of said piston along said rod until said loop is filled with displacement fluid.

15. A dispenser for a fluid material, comprising a flexible container, a piston comprised of a material that enables the piston to be flexed, said piston being movable within the container, an expansible bladder connected to said piston, a first passageway into the container and communicating with the interior of said bladder, a first check valve cooperating with said first passageway and allowing flow of a displacement fluid only from outside the container into the interior of said bladder, and a second check valve allowing flow of material only from within an interior portion of the container external to said bladder to outside the container.

16. A dispenser as set forth in claim 15, comprising a second passageway into the container communicating with an interior portion of the container external to said bladder, said second check valve cooperating with said second passageway.

17. A dispenser as set forth in claim 15, wherein said piston substantially obturates the container.

18. A dispenser as set forth in claim 15, wherein said bladder is comprised of a material that is substantially unstretchable, and said bladder surrounds said first passageway and is connected to one end portion of said container remote from the second check valve.

19. A dispenser as set forth in claim 18, wherein said rod is connected to the container at said one end portion.

20. A dispenser as set forth in claim 15, further comprising a rod supported in the container, said piston being movable on said rod.

21. A dispenser as set forth in claim 20, wherein said piston is in direct frictional and sealing engagement with said rod.

22. A dispenser as set forth in claim 20, said container including two end portions and a side wall extending between the two end portions, wherein said bladder is arranged in the container such that when the container contains fluid material said bladder forms a loop that extends up the container side wall in advance of said piston with respect to piston movement toward said second check valve.

23. A dispenser as set forth in claim 22, wherein said piston separates the container into a dispensing section for containing material and a displacement section for containing displacement fluid, and displacement fluid acts on a portion of the loop of said bladder in the dispensing section to frictionally move said piston on said rod.

24. A dispenser for a fluid material, comprising a flexible, resilient container having a dispensing end and an opposite end, a bladder within the container attached at the opposite end and of a shape and size to substantially fill the container when the bladder is fully inflated, a check valve at the dispensing end that allows outflow of contents when the container is squeezed and prevents inflow of displacement fluid when the container returns to its original volume, an inlet passage to the bladder, a check valve allowing displacement fluid to enter the bladder from outside the container through the inlet passage and preventing displacement fluid from exiting the bladder, and a piston movable within the container from the opposite end toward the dispensing end, the piston being comprised of a material that enables the piston to be flexed, and the piston essentially obstructing the cross-section of the container, whereby flow of the contents of the container is obstructed in a direction from the dispensing end toward the opposite end of the container.

25. A dispenser as set forth in claim 24, wherein said piston separates the container into a dispensing section for containing material and a displacement section for containing displacement fluid, and displacement fluid acts on a portion said bladder that is located in the dispensing section to frictionally move said piston on said rod.

26. A dispenser for a fluid material, comprising a flexible, resilient container having a dispensing end and an opposite end, a rod supported in the container, a collar movable on said rod, said collar being in direct frictional and sealing engagement with said rod, a bladder within the container attached at the opposite end and to said collar, said bladder having a shape and size to substantially fill the container when the bladder is fully inflated, first flow restricting means for allowing flow of displacement fluid only from outside the container into the interior of said bladder, and second flow restricting means for allowing flow of material only from within an interior portion of the container external to said bladder to outside the container.

27. A dispenser for a fluid material, comprising a flexible container having a dispensing end portion and another end portion, a piston adapted for movement within the container, an expansible bladder connected to said piston, first flow restricting means for allowing flow of displacement fluid only from outside the container into the interior of said bladder, said first flow restricting means comprising a passageway into the container communicating with the interior of said bladder, said passageway including a tube connected to the container at said dispensing end portion and a check valve cooperating with said tube, said piston being movable on said tube, and second flow restricting means for allowing flow of material only from within an interior portion of the container external to said bladder to outside the container.

28. A dispenser as set forth in claim 27, further comprising a cap at said dispensing end portion and a support member disposed in the interior of said cap, wherein said support member includes a central hub and spokes extending outwardly from the hub, said tube being fastened to the hub.

29. A dispenser as set forth in claim 28, wherein said support member includes a conduit forming part of said passageway, said conduit communicating said tube to the exterior of the container.

30. A dispenser for a fluid material, comprising a flexible, resilient container having a dispensing end and an opposite end, an elongated guide supported in the container, a bladder within the container attached at the opposite end and having a shape and size to substantially fill the container when the bladder is fully inflated, means cooperable with the guide for resisting movement of the bladder toward the dispensing end, said means cooperable with the guide being in direct frictional and sealing engagement with the guide, first flow restricting means for allowing flow of displacement fluid only from outside the container into the interior of said bladder, and second flow restricting means for allowing flow of material only from within an interior portion of the container external to said bladder to outside the container.

31. A dispenser as set forth in claim 30, said container including a side wall between the dispensing end and the opposite end, wherein said bladder is arranged in said container and its movement is restricted by said means cooperable with the guide so that said bladder forms a loop that extends along the container side wall in advance of said means cooperable with the guide with respect to piston movement toward said second flow restricting means.

* * * * *